United States Patent [19]

Wells

[11] Patent Number: 5,047,004

[45] Date of Patent: Sep. 10, 1991

[54] AUTOMATIC DECANTING CENTRIFUGE

[76] Inventor: John R. Wells, 4372 Keystone Ave., Culver City, Calif. 90232

[21] Appl. No.: 476,981

[22] Filed: Feb. 7, 1990

[51] Int. Cl.[5] ..... B04B 5/02; B04B 11/00

[52] U.S. Cl. ..... 494/17; 494/20; 494/37

[58] Field of Search ..... 494/20, 16, 17, 19, 494/37; 210/781, 782

[56] References Cited

U.S. PATENT DOCUMENTS

| | | | |
|---|---|---|---|
| 3,420,437 | 1/1969 | Blum et al. | 494/20 |
| 3,951,334 | 4/1976 | Fleming | 494/20 |
| 4,285,463 | 8/1981 | Intengan | 494/20 |
| 4,431,423 | 2/1984 | Weyant | 494/20 |

*Primary Examiner*—Robert W. Jenkins

*Attorney, Agent, or Firm*—Donald G. Lewis

[57] ABSTRACT

A centrifuge having an automatic dispensing rotor is employed for pelleting material and automatically decanting supernatant liquid by means of gravity drainage. The automatic decanting rotor employs a magnetically activated lock mechanism for locking swinging buckets in an elevated position while the rotor is at speed. When the rotor is brought to rest, the swinging buckets do not pivot to their rest position but are sustained in their elevated position by means of the magnetically activated lock. Liquids are automatically decanted from the swinging buckets when the rotor is brought to rest while the swinging buckets are sustained within their elevated position.

15 Claims, 4 Drawing Sheets

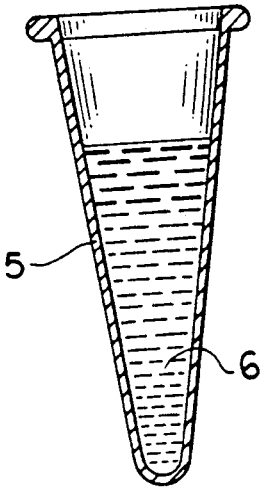
FIG. 3
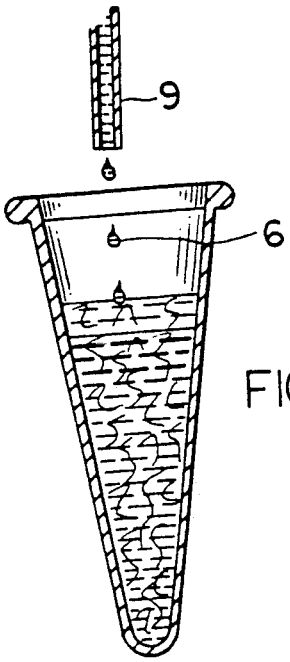
FIG. 7
FIG. 4
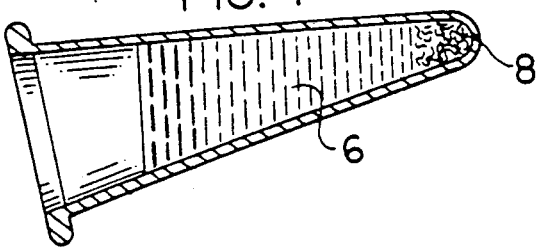
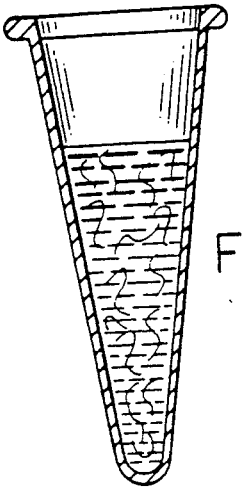
FIG. 8
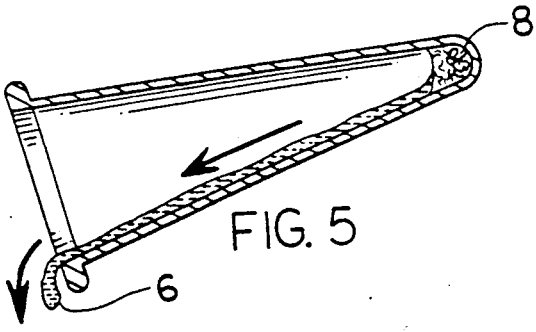
FIG. 5
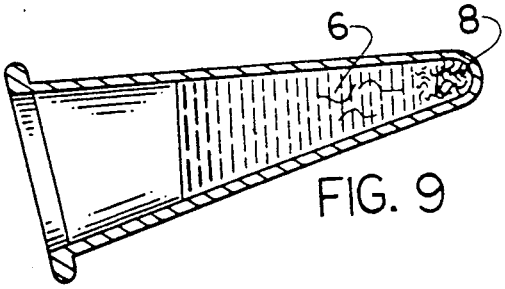
FIG. 9
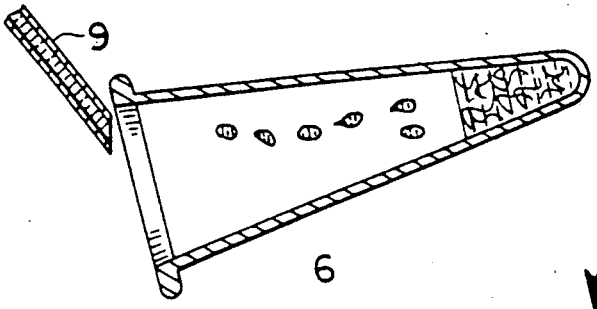
FIG. 6
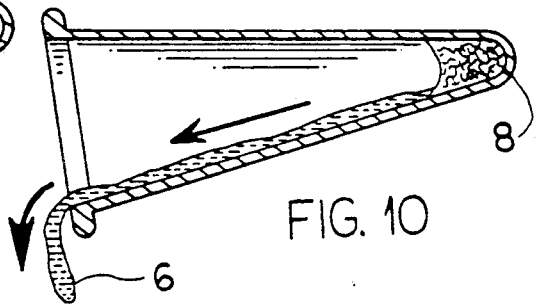
FIG. 10

AUTOMATIC DECANTING CENTRIFUGE

The invention relates to centrifuges. More particularly, the invention relates to centrifuges which employ swinging bucket rotors having the capability to decant liquids automatically.

BACKGROUND

Centrifugation is often employed for separating suspended cells and other particulates from a liquid component. Examples of fields which employ centrifugation in this manner include cellular biology, hematology, cellular diagnostics, and cellular therapy. During centrifugation, the cellular component sediments and forms a pellet at the centrifugal end of the container. Meanwhile, the liquid component forms a liquid supernatant above the pellet. After the pelleting process has been completed, the supernatant is decanted from the container, taking care to leave the pellet behind.

The initial separation step may be followed by one or more wash steps. During each wash step, the cellular component is resuspended in a wash liquid. The resuspended cellular component is then pelleted once again by means of centrifugation. The supernatant wash liquid is then decanted from the container, taking care once again to leave the washed pellet behind. If a particularly thorough wash is desired, the pelleted cellular component may be repeatedly washed in a serial fashion by means of this protocol.

The wash steps may be followed by one or more chemistry steps. During a chemistry step the washed cells may be treated with a reagent which reacts with the cells or a subpopulation of the cells. The cells may be chemically labelled by the reagent or may be otherwise chemically modified or treated. For example, labelled antibodies may be employed to bind to cells having specific surface antigens. Cells lacking the specific surface antigen remain unlabelled. After the chemistry step, unreacted reagent may be separated from the cellular component by means of further wash steps, similar in protocol to the earlier wash steps, each employing centrifugation and decantation.

Pioneer workers in cellular biology and related fields were required to performed several steps of the wash cycle in a manual fashion, viz. removing the centrifuge tubes from the centrifuge rotor after the initial pelleting; decanting the supernatant liquid from the centrifuge tubes; adding wash liquid to the pellet; re-suspending the pellet within the wash liquid; and remounting the centrifuge tubes back onto the centrifuge rotor for further pelleting. These manual operations can be laborious and tedious. Such tedium can lead to technician error.

Special centrifuge rotors have been developed for eliminating much of this tedium. Such centrifuge rotors have been designed to load and unload liquids directly to and from centrifuge tubes which remain mounted on a centrifuge rotor. Fleming et al. (U.S. Pat. No. 3,951,334) and Weyant, Jr. (U.S. Pat. No. 4,431,423) disclose a centrifuge from which liquid may be decanted without unmounting the centrifuge tubes. Intengan (U.S. Pat. No. 4,285,463) discloses a centrifuge from which liquid may be decanted and into which liquids may be dispensed without unmounting the centrifuge tubes from the centrifuge rotor.

Each of the above devices employs centrifugal draining to decant liquid from the centrifuge tube. During centrifugal draining, the centrifuge tube is held at a negative angle with respect to the vertical such that the bottom of the centrifuge tube is closer to the axis of the rotor than the top of the centrifuge tube. The centrifuge rotor is then spun while the centrifuge tubes are held at this negative angle. The rotational speed of the centrifuge is sufficient to drive the liquid from the centrifuge tube by means of centrifugal force.

Unfortunately, centrifugal draining can result in aerosol formation within the bowl of the centrifuge. After the liquid leaves the centrifuge tube, it may splash at high velocity against the wall of the bowl. The resulting aerosol may be difficult to contain and, if the cellular samples are biohazardous, the uncontained aerosol may dangerously contaminate the work place.

Centrifugal draining can also result in the loss of pellet material. Unless the cellular component forms a tight pellet at the bottom of the centrifuge tube, centrifugal draining can drive the cellular component out of the centrifuge tube with the liquid component. Hence, the utility of centrifugal draining may be limited to the separation of cellular components which pellet tightly or for which a partial loss of the cellular component is acceptable.

What is needed is a centrifuge which can dispense liquids directly into centrifuge tubes, which can spin such liquids so as to form a pellet, and which can automatically decant such liquids from the centrifuge tubes with little or no aerosol formation and/or with little or no loss of pellet material.

SUMMARY OF THE INVENTION

The invention is an automatic decanting rotor for use with a centrifuge for separating pelletable material from liquid components. The automatic decanting rotor is novel because it employs gravity drainage for decanting liquids from centrifuge tubes while such centrifuge tubes remain mounted on the automatic decanting rotor. The automatic decanting rotor is of the type which employs swinging buckets that pivot from a rest position to an elevated position in response to the application of centrifugal force. The invention teaches that, after such swinging buckets have pivoted to their elevated position, they may be locked within this position by means of a magnetic lock mechanism or the equivalent. Once the swinging buckets are locked within this elevated position, they remain within this elevated position even when the applied centrifugal force has been eliminated, i.e. after the automatic decanting rotor comes to a stop and the swinging buckets would normally pivot bact to their rest positions. Once the swinging buckets are locked in their elevated position, the elimination of the centrifugal force allows liquid to drain freely from the centrifuge tubes by the force of gravity alone.

As compared to centrifugal drainage, gravity drainage applies less force to the decanted liquid and is consequently more easily adapted to reduce or eliminate the formation of aerosols arising during such decanting process. Similarly, as compared to centrifugal drainage, gravity drainage is more easily adapted to reduce the loss of pellet material resulting from such the decanting process.

The automatic decanting rotor may be constructed by combining a swinging bucket rotor with a lock mechanism. The lock mechanism is adapted so as to lock the swinging buckets in their elevated position during centrifugation and to sustain the swinging buckets in this elevated position after the centrifugal force is eliminated. More particularly, the lock mechanism is adapted so as to sustain the centrifuge tubes mounted within such swinging buckets at an angle which is horizontal or near horizontal so as to allow liquid to drain from such centrifuge tubes by the force of gravity.

The speed and efficiency of the gravity drainage process may be enhanced by employing a negative drainage angle, i.e. an off-horizontal drainage angle in which the mouth of the centrifuge tube has a lower elevation than the opposite or centrifugal end of the centrifuge tube. One method for achieving an off-horizontal drainage angle involves the use of off-center pinions for supporting the swinging buckets. The use of off-center pinions causes the swinging buckets to hang at an off-vertical position while at rest and to pivot to an off-horizontal position during centrifugation. The speed and efficiency of the drainage process will be enhanced if, within this off-horizontal position, the elevation of the mouth of the centrifuge tube is slightly lower than the opposite or centrifugal end of the centrifuge tube.

The speed and efficiency of drainage may also be enhanced by employing tapered centrifuge tubes. Tapered centrifuge tubes have a wide mouth and a bottom which is relatively more narrow. If a tapered centrifuge tube is oriented in a horizontal position, the taper of such centrifuge tube will cause the lowest portion of the mouth to be lower than the lowest portion of the opposite end of the centrifuge tube, i.e. the end which normally serves as the bottom. Hence there will be a negative drainage angle with respect to gravity drainage.

In a preferred embodiment, the mouth of the tapered centrifuge tube is oval with the long axis of the oval oriented in a substantially vertical direction during the drainage process. This feature allows closer packing of centrifuge tubes onto the automatic decanting rotor.

Although the use of an off-horizontal drainage angle may serve to accelerate the drainage process and enhance its completeness, the use of an excessive drainage angle can result in the loss of pellet material. During centrifugation, pelletable material quickly sediments to centrifugal end of the centrifuge tube where a pellet is formed. During the decanting process, the liquid component is drained from the centrifuge tube while the pellet remains behind. Unfortunately, some of the pellet material may be lost if it is decanted with the liquid component. For many applications, it is considered undesirable to lose pellet material during the decanting process. Consequently, the optimal drainage angle will not only drain liquid efficently, but will also minimize the loss of pellet material. Accordingly, the optimal drainage angle will depend upon the nature of the material which has been pelleted and the magnititude and duration of the applied centrifugal force employed during the pelleting process. If the pellet material is relatively sticky and is tightly bound to the centrifuge tube, a relatively large drainage angle may be employed. On the other hand, if the pellet material is not tightly bound to the centrifuge tube and if it is essential to minimize its loss, a horizontal or relatively shallow drainage angle may be employed.

The invention also includes various methods which employ the automatic decanting rotor. For example, the invention includes methods which employ the automatic decanting rotor for pelleting material and automatically decanting the supernatant liquid which lies above the resultant pellet.

The invention also includes methods which employ the automatic decanting rotor for serially washing pelletable material. Combining the automatic decanting rotor with a liquid dispensing means allows pelletable material to be washed repeatedly without removing the centrifuge tubes from the centrifuge rotor. The liquid dispensing means is of the type which is capable of dispensing liquids, including wash liquids, into centrifuge tubes while such centrifuge tubes remain mounted within the automatic decanting rotor. Hence, after the pelletable material has been initially pelleted and the supernatant liquid decanted, the pellet material may be resuspended in a wash solution by means of the liquid dispensing function. The pelletable material may then be re-pelleted and the wash solution decanted once again. The invention enables this cycle to be repeated serially without removing the centrifuge tubes from the automatic decanting rotor.

The invention also includes methods for treating pelletable material with chemically reactive reagents. One or more reagents may be dispensed into the centrifuge tubes by means of an expanded version of the liquid dispensing means. If small quantities of reagent are employed, contact between the reagent and the pellet may be improved by forcing the reagent atop the pellet by means of centrifugal force. The invention also discloses how the reagents may be mixed with the pellet material. After an optional incubation period, the pellet material may be washed of unreacted reagent by further wash cycles. All of these steps may be performed without unmounting the centrifuge tubes from the automatic decanting rotor.

It is a broad object of this invention to enable liquid to be decanted directly from a centrifuge rotor by means of gravity draining without removing the centrifuge tubes from the rotor.

It is a clinically significant object of this invention to provide an automatic method for separating pelletable cellular materials from liquid components.

Specifically, an object of the invention with the greatest clinical significance is the use of the automatic decanting rotor for automating the initial separation of pelletable cellular material from its liquid component, for washing of such pelletable cellular material with wash liquid added by means of a liquid dispensing function, and for treating and washing such pelletable cellular material with chemically reactive reagents.

BRIEF DESCRIPTION OF THE DRAWINGS

FIG. 1 (*b*) is plan view from below illustrating the interaction between the cap and the liquid dispensing means of FIG. 1 (*a*).

FIG. 2 (*b*) is plan view from below of a rotatable support for supporting the swinging bucket of FIG. 2 (*a*) and the locket within its activated position.

FIG.'S 3–16 illustrate the method of the invention.

FIG. 3 is a sectional view of a swinging bucket in the absence of a centrifugal force and in the rest position loaded with a liquid component.

FIG. 4 is a sectional view of the swinging bucket of FIG. 3 in the presence of a centrifugal force and in the elevated position with pelletable component being pelleted to the bottom of the swinging bucket.

FIG. 5 is a sectional view of the swinging bucket of FIG. 4 in the absence of a centrifugal force but in the elevated position as held by the lock with the liquid component being decanted from the swinging bucket leaving the pellet behind.

FIG. 6 is a sectional view of the swinging bucket of FIG. 5 in the presence of a centrifugal force with a wash liquid being added to the swinging bucket.

FIG. 7 is a sectional view of the swinging bucket of FIG. 5 in the absence of a centrifugal force and in the rest position illustrating an alternative method for adding wash liquid.

FIG. 8 is a sectional view of the swinging bucket of FIG. 7 in the absence of a centrifugal force and in the rest position illustrating the suspension of the pellet into the wash liquid.

FIG. 9 is a sectional view of the swinging bucket of FIG. 6 or 8 in the presence of a centrifugal force and in the elevated position illustrating the pelleting of the pelletable component through the wash liquid.

FIG. 10 is a sectional view of the swinging bucket of FIG. 9 in the absence of a centrifugal force but in the elevated position as held by the lock with the wash liquid being decanted from the swinging bucket leaving the pellet behind.

Figure 1B:
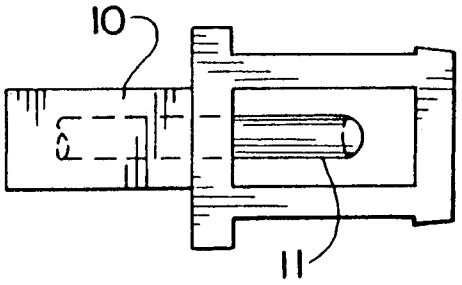
FIG. 1 (*a*) is sectional view of an automatic decanting centrifuge in the absence of a centrifugal force, illustrating a swinging bucket positioned in its rest position, a lock in its deactivated position, and a self closing cap positioned in its open position.
Figure 1A:
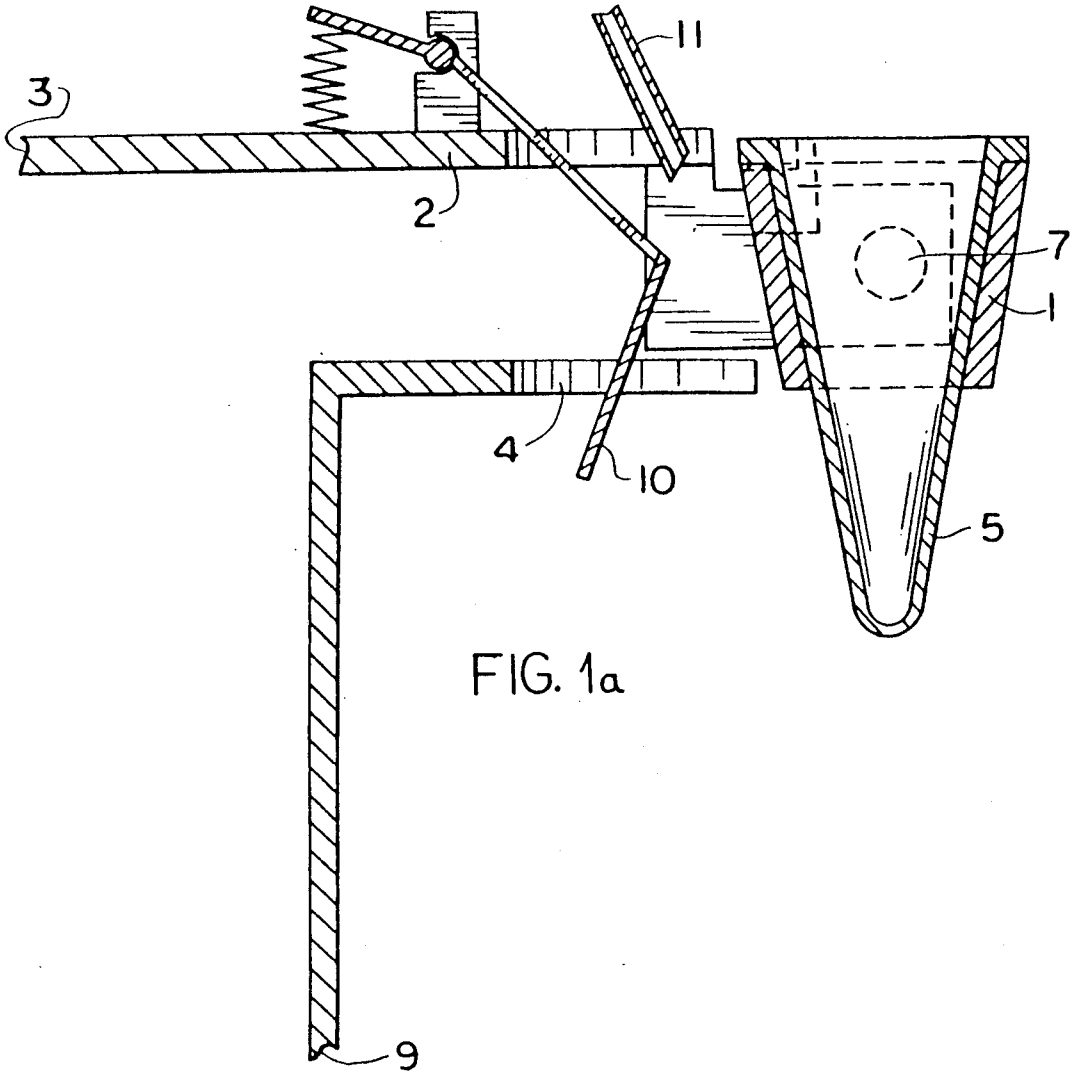
Figure 2A:
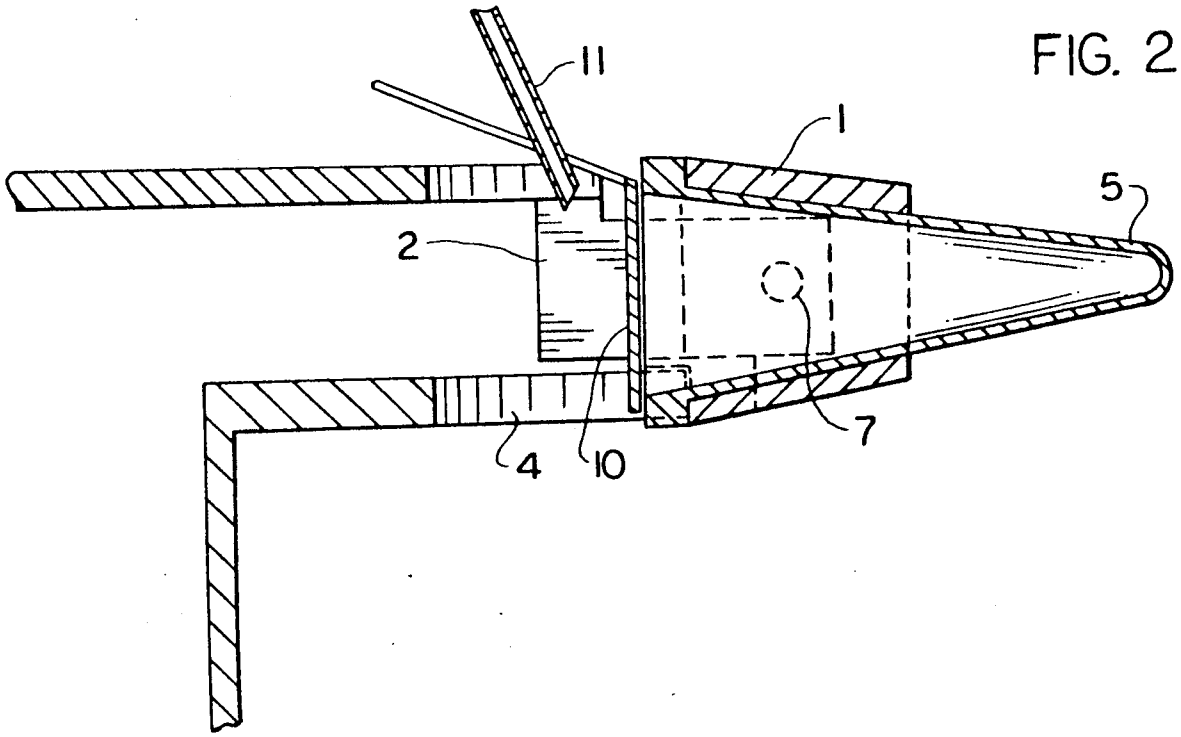
FIG. 2 (*a*) is sectional view of the automatic decanting centrifuge of FIG. 1 (*a*) in the presence of a centrifugal force, illustrating the swinging bucket positioned in its elevated position and the self closing cap positioned in its closed position.
Figure 2B:
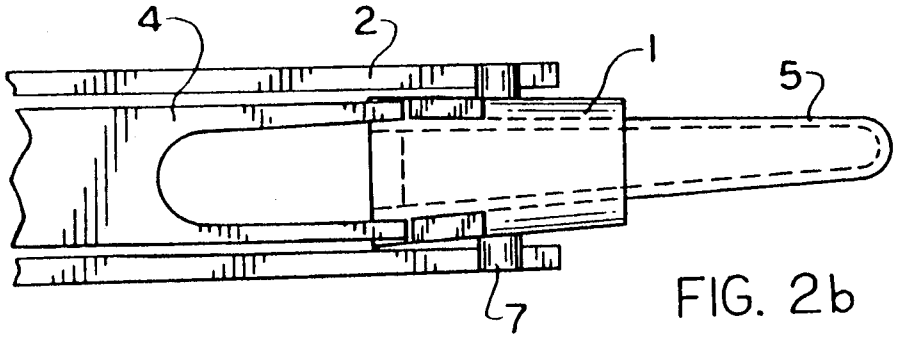
Figure 11:
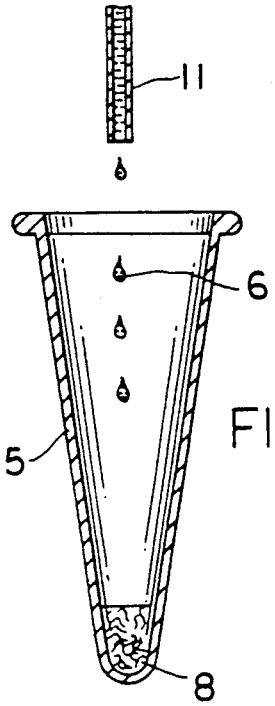

FIG. 11 is a sectional view of the swinging bucket of FIG. 10 in the absence of a centrifugal force and in the rest position with a reagent solution being added to the pellet.

Figure 12:
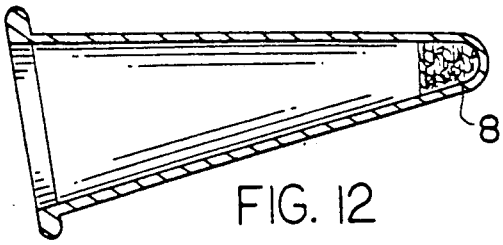

FIG. 12 is a sectional view of the swinging bucket of FIG. 11 in the presence of a centrifugal force and in the elevated position with a reagent solution being driven onto the pellet by centrifugal force.

Figure 13:
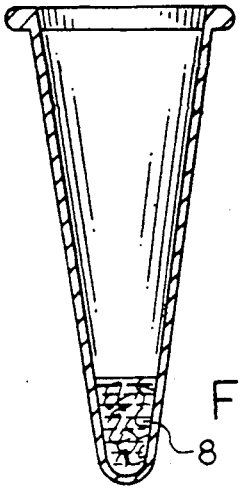

FIG. 13 is a sectional view of the swinging bucket of FIG. 12 in the absence of a centrifugal force and in the rest position with a reagent solution incubating with the pellet.

Figure 14:
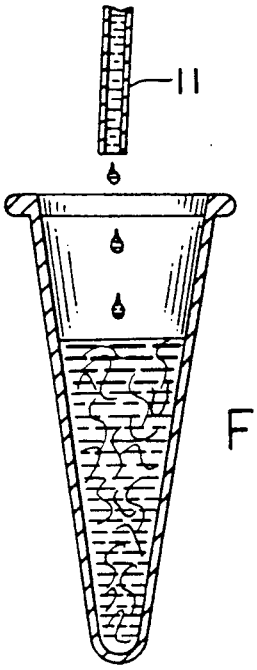

FIG. 14 is a sectional view of the swinging bucket of FIG. 13 in the absence of a centrifugal force and in the rest position with a wash liquid being added atop the pellet and resuspending the pellet.

Figure 15:
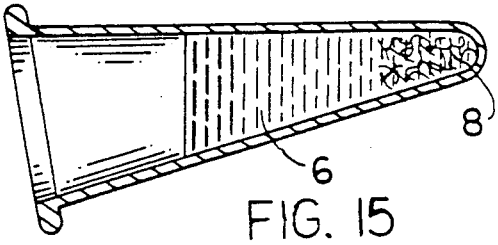

FIG. 15 is a sectional view of the swinging bucket of FIG. 14 in the presence of a centrifugal force and in the elevated position with the pelletable material pelleting to the bottom of the swinging bucket.

Figure 16:
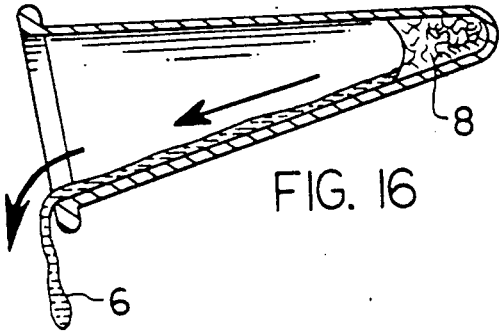

FIG. 16 is a sectional view of the swinging bucket of FIG. 15 in the absence of a centrifugal force but in the elevated position as held by the lock with the wash liquid and reagent being decanted from the swinging bucket leaving the pellet behind.

DETAILED DESCRIPTION

DESCRIPTION OF THE APPARATUS

The preferred embodiment of the automatic decanting rotor includes swinging buckets (1), a rotatable support (2) for supporting the swinging buckets (1), a rotational drive or drive shaft (3) for rotationally driving the rotatable support (2), and a lock mechanism (4) for sustaining the swinging buckets (1) in an elevated position. Centrifuge tubes (5) for containing the sample liquid (6) may be mounted by the user within the swinging buckets (1). The swinging buckets (1) include a pinion (7) or a pinion hole from which they are suspended and around which they may pivot. In the absence of a centrifugal force, the swinging buckets (1) are drawn by gravity or some other restoring force to a rest position. A preferred rest position is substantially vertical, i.e. the centrifuge tubes (5) are in a substantially upright position with the open end of the tube (5) at the top so as to retain the liquid (6) therein. With the application of a centrifugal force, the swinging buckets (1) will tend to pivot from their vertical rest position to an elevated position. In a preferred elevated position the centrifuge tubes (5) lie substantially horizontally with open end of the centrifuge tubes (5) situated in a centripedal position and the bottom of the centrifuge tubes (5) situated in a centrifugal position. During centrifugation, pelletable material (8) will tend to sediment from the sample liquid (6) to the bottom of the centrifuge tube. Except to the extent that the pivoting action of the swinging bucket (1) is modified by the lock mechanism (4), the swinging bucket (1) of the present invention share some similarity to swinging bucket rotors described in the U.S. patents of Intengan, Fleming, and Weyant, Jr., cited above. The rotatable support (2) and the rotational drive (3) may also be very similar to the rotatable supports and the rotational drives described in the U.S. patents of Integngan, Fleming, and Weyant, Jr., cited above, except to the extent that these elements must be modified to accomodate the lock mechanism (4).

The lock mechanism (4) is employed so as to lock the swinging bucket (1) in the elevated position during centrifugation and so as to sustain the swinging bucket (1) in the elevated position after centrifugation, when the swinging bucket (1) is as rest. When employed, the lock mechanism (4) prevents the swinging bucket (1) from pivoting to its rest position after centrifugation. If the swinging bucket (1) is sustained in the elevated position in the absence of a centrifugal force, the sample liquid (6) will drain by gravity flow from the centrifuge tube. On the other hand, if the pelletable material (8) has pelleted to the bottom of the centrifuge tube, the pellet will tend to remain within the centrifuge tube.

In a preferred mode, the lock mechanism (4) or sustaining means includes two principal elements, viz. a lock and an electromagnet. The lock is rotationally coupled to the rotational drive (3) such that the lock rotates with same rotational velocity and around the same axis as the rotational drive (3). Furthermore, the lock is capable of translational motion parallel to the axis of rotation between a locked position and an unlocked position. When translated into the locked position during centrifugation, the lock engages the swinging bucket (1) while the swinging bucket (1) is in the elevated position. After the completion or termination of centrifugation when the rotational support stops its rotation, the engagement of the lock with the swinging bucket (1) will sustain the swinging bucket (1) in the elevated position and prevent it from pivoting to its rest position. When the lock is translated to the unlocked position, the lock no longer engages the swinging bucket (1) so as to sustain the swinging bucket (1) in the elevated position. When the lock is not engaged with the swinging bucket (1), the swinging bucket (1) will pivot from its elevated position to its rest position as the rotational support rotationally slows down and stops.

The lock is translationally driven between the locked and unlocked positions. In the preferred embodiment, the lock is translationally driven to the locked position by means of enerizing the electromagnet. When the electromagnet is de-energized, the lock is returned to its unlocked position by gravity or by some other restoring force. Alternatively, the lock may be translationally driven to the locked position by means of gravity and returned to the unlocked position by means of the electromagnet.

In the preferred embodiment, the electromagnet is mounted co-axially with the rotational drive (3) but rotationally uncoupled from the rotational drive (3). The lock includes a portion (9) which has a high magnetic suspectibility. This portion (9) of the lock with high magnetic susceptibility interacts with the magnetic flux lines of the electromagnet. When the electromagnet is energized, the magnetically susceptible portion (9) of the lock is drawn into the magnetic flux lines of the electromagnet. This causes the lock to translate into it locked position. When the electromagnet is de-energized, the magnetically susceptible portion of the lock is released from the magnetic flux lines of the electromagnet and the lock is translationally returned to its unlocked position by means of gravitational pull or some other restoring force.

Alternative embodiments of the decanting rotor may include swinging buckets (1) with off-centered pinions or pinion holes. In this alternative embodiment, the pinions or pinion holes are positioned such that, in the elevated position, the open end of the centrifuge tube (5) is slightly lower than the centrifugal end. This allows the liquid (6) within the centrifuge tube (5) to drain more nearly completely from the centrifuge tube (5) at the end of the centrifugation process.

In an other alternative embodiment, the decanting rotor also includes self closing caps (10). These self closing caps (10) are suspended from the rotational support. During centrifugation, swinging bucket (1) pivots to the elevated position and the self closing caps (10) pivot towards the open end of the centrifuge tube (5) held therein so as to close of the centrifuge tube (5). This prevents the loss of liquid (6) from the centrifuge tube (5) during centrifugation due to air turbulence. At the conclusion of the centrifugation step, the self closing caps (10) are pulled by gravity or some other restoring force to an open position. If the swinging bucket (1) has been sustained in its elevated position by means of the lock mechanism (4), the pivoting of the self closing caps (10) after centrifugation allows the liquid (6) within the centrifuge tubes (5) to freely drain from the centrifuge tubes (5) by gravity. If the swinging bucket (1) has not been sustained in its elevated position by means of the lock mechanism (4), after centrifugation, the self closing caps (10) will pivot from their closed position to their open position while the swinging buckets (1) pivot from their elevated position to their rest position. In the open position, the centrifuge tubes (5) are uncapped and the user is free to unmount and remove the centrifuge tubes (5) from the swinging buckets (1) or to manually add and/or remove material from the open end of the centrefuge tubes (5).

In another alternative embodiment, the decanting rotor includes one or more receptacles for receiving liquid while the liquid (6) is drained from the centrifuge tube (5) in the elevated position. The receptacle is positioned directly below the open end of the centrifuge tubes (5) as the centrifuge tubes (5) held by the swinging buckets (1) in the elevated position. The receptacles capture the liquid (6) as it is drained from the centrifuge tubes (5). The receptacles may be rotationally coupled or uncoupled to the rotational drive (3).

In another alternative embodiment, the decanting rotor includes a mechanism for applying high frequency vibration to the centrifuge tubes (5) after the liquid. (6) has drained off. The high frequency vibrations are applied to the centrifuge tube (5) when the swinging buckets (1) are in their resting position. In a preferred mode of this alternative embodiment, an ultra sonic probe is vibrationally coupled to the rotational drive (3). For example, while the rotational drive (3) is as rest, an ultra sonic probe may be brought into contact with the rotational drive (3). When the ultra sonic probe is activated, vibrations will travel through the rotational drive (3), the rotational support, the pinions (7), the swinging buckets (1), and into the centrifuge tubes (5). In an alternative preferred mode, the high frequency vibrations may be generated by an excentric motor having an off center cam. In either event, the application of high frequency vibration will tend to cause pellet material (8) to detach from from the bottom of the centrifuge tube (5) and to become re-suspended in small volumes of liquid.

In a preferred embodiment, the centrifuge tubes (5) are tapered so as to facilitate the drainage of liquid (6). Tapered centrifuge tubes (5) may have a conical shape with the mouth being wider than the bottom. If a tapered centrifuge tube (5) is sustained in a horizontal position by the swinging bucket (1), the lowest portion of the mouth will be lower in elevation than the lowest portion of the bottom. Hence, liquid (6) will drain efficiently from a tapered centrifuge tube (5) held in this position. In order to increase the number of centrifuge tubes (5) which can be mounted on one automatic decanting rotor, the centrifuge tubes (5) may have an oval shape in which the long axis of the oval lies parallel to the axis of the drive shaft when the centrifuge tubes (5) are positioned in their elevated position, i.e. horizontal or near horizontal positions. On the other hand, conventional untapered centrifuge tubes (5) with cylindrical walls may also be employed with the automatic decanting rotor.

DESCRIPTION OF THE METHOD

The invention includes the method of using the automatic decanting rotor for decanting liquids (6). In an elementary application of this method, a pelletable material (8) such as blood is first loaded into a centrifuge tube. The loaded centrifuge tube (5) is then inserted into swinging bucket (1) which may then be mounted onto the automatic decanting rotor in its resting position. The automatic decanting rotor may then be balanced and mounted into a centrifuge. The automatic decanting rotor is then rotationally accelerated by the centrifuge to a rotational speed sufficient to create a centrifugal force for causing the swinging bucket (1) to pivot from its rest position to its elevated position and for causing one or more of the pelletable cellular components within the blood to sediment and form a pellet. A supernatant liquid (6) will be displaced centripetally from the pellet material (8). During the centrifugation process, the lock mechanism is "activated" so as to lock the swinging bucket (1) within its elevated position. If the lock (4) is magnetically activated, the "activation" may consist of either energizing the magnet or de-energizing the magnet, depending upon which configuration causes the lock to sustain the swinging buckets (1) in their elevated positions. After the pellet has formed, the automatic decanting rotor is then rotationally decelerated until it comes to a stop. At this point, the centrifugal force has been eliminated. In the absence of the centrifugal force, the swinging bucket (1) is sustained in its elevated position entirely by means of the lock mechanism. With the elimination of the centrifugal force and with the centrifuge tube (5) being sustained in the elevated position, the supernatant liquid (6) is decanted from the centrifuge tube (5) by means of gravity drainage.

The utility of the automatic decanting rotor may be significantly enhanced by the addition of a liquid dispensing means (11). The automatic decanting rotor may be employed with a liquid dispensing means (11) for automatically washing pelletable material (8) and for automatically treating such pelletable material (8) with reagents. Methods for combining liquid dispensing means (11) with swinging bucket rotors are described in the prior art and may be adapted for dispensing liquid (6) into the centrifuge tubes (5) of the automatic dispensing rotor described herein.

There are two preferred methods for dispensing liquid (6) into the automatic dispensing rotor, viz. the stationary method and the centrifugation method.

The stationary method for dispensing liquid (6) requires that the automatic dispensing rotor be at rest with the swinging buckets (1) be in their rest position, i.e. vertical or substantially vertical, and with the liquid dispensing means (11) being aligned with the individual centifuge tubes (5). If it is desired to dispense liquid (6) into centrifuge tubes (5) after such centrifuge tubes (5) have been drained in their elevated position, it is necessary to restore the swinging buckets (1) back into their rest position. A preferred method to do this is to apply a gentle centrifugal force to the swinging buckets (1) and then to deactivate the lock mechanism. When the centrifugal force is then eliminated, the swinging buckets (1) will pivot to their rest position. The individual centrifuge tubes (5) are then aligned by rotation with the liquid dispensing means (11) so that liquid (6) dispensed by the liquid dispensing means (11) will enter the appropriate centrifuge tube.

The centrifugal method for dispensing liquid (6) requires that the automatic dispensing rotor be rotating and that the swinging buckets (1) be in their elevated position. Hence, to dispense liquid (6) into the centrifuge tubes (5), all that is required is that the the automatic dispensing rotor be brought up to speed. In a preferred method, the liquid dispensing means (11) is rotationally aligned with the individual centrifuge tubes (5) so that when liquid (6) is dispensed it is driven centrifugally into the corresponding centrifuge tubes (5).

The liquid dispensing means (11) may be employed in conjunction with the automatic dispensing rotor for repeatedly washing pelletable material (8) in a serial fashion. After the pelletable material (8) has been initially pelleted and separated from its original supernatant liquid (6) by means of automatic decantation, a wash liquid (6) is added to the centrifuge tube (5) by either the stationary or centrifugal methods described above. The pelleted material (8) is then suspended within this wash liquid (6) and re-pelleted by the application of a further centrifugal force. The wash liquid (6) is then decanted as described for the initial automatic decanting protocol. The process of added wash liquid (6), resuspending the pellet, re-pelleting the pelletable material (8), and decanting the wash supernatant may be repeated serially for as many times as the user may wish.

The liquid dispensing means (11) may also be employed in conjunction with the automatic dispensing rotor for treating pelletable material (8) with a reagent. Reagent liquids (6) may be added by the liquid dispensing means (11) in a fashion similar to the addition of wash liquids (6) described above. However, if it desired to add only small quantities of the reagent liquid (6) due to cost or other factors, the reagent liquid (6) may be forced onto the pellet by means of centrifugal force. Typically after the addition of a reagent, there will be an incubation period. The incubation period may occur either while the centrifuge is at rest or while it is at speed. At the end of the incubation period, the user may which to wash away excess reagent which is unreacted or unemployed by the addition of a diluant. Diluant may be added to the centrifuge tubes (5) by means of the liquid dispensing means (11) as described above. Similarly, pelletable material (8) may be re-pelleted and the diluant and excess reagent may then be decanted from the pellet material (8) by a method exactly analogous to the method employed above for the separation of wash liquid (6) from the pelletable material (8).

If the pellet material (8) is particularly tightly bound the to centrifuge tube, it may be desired to enhance the mixing of the reagent with the pellet material (8). After the reagent has been driven onto the pelleted material (8) by centrifugal force, the automatic decanting rotor is brought to rest. The reagent and pellet material (8) may then be mixed by the application of high frequency vibration from a sonic probe or by eccentric motor with an off center cam.

What is claimed is:

1. An improved centrifuge of a type having a rotor with a swinging bucket pivotable into an elevated position in the presence of a centrifugal force and pivotable into a rest position in the absence of the centrifugal force, wherein the improvement comprises:

a lock activable and de-activable in the presence of the centrifugal force, said lock, when activated, for sustaining the swinging bucket in the elevated position in the absence of the centrifugal force and said lock, when de-activated, for allowing the swinging bucket to pivot into the rest position in the absence of the centrifugal force.

2. An improved centrifuge as described in claim 1 wherein the improvement further comprising:

a self closing cap pivotable between an open position and a closed position for opening and closing said swinging bucket, said self closing cap automatically pivoting to the closed position during the application of the centrifugal force, said self closing cap automatically pivoting to the open position in the absence of the centrifugal force.

3. A centrifuge for separating a pelletable component from a liquid component, the centrifuge comprising:

a rotor having a swinging bucket and a rotatable support for pivotably supporting said swinging bucket, a means for rotationally driving said rotatable support for imparting a centrifugal force to said swinging bucket, said swinging bucket being pivotable with respect to said rotatable support for assuming a rest position in the absence of the centrifugal force and for assuming an elevated position with the application of the centrifugal force, and a lock translatable between a locked position and an unlocked position in the presence of the centrifugal force, said lock, when in the locked position, for sustaining said swinging bucket in the elevated position in the absence of the centrifugal force, said lock, when in the unlocked position, for allowing said swinging bucket to pivot into the rest position in the absence of the centrifugal force.

4. A centrifuge as described in claim 3 wherein:

said lock, when activated, for sustaining said swinging bucket in the elevated position in the absence of the centrifugal force for allowing the liquid component to automatically decant by gravity from said swinging bucket while allowing the pelletable component to remain in said swinging bucket.

5. A centrifuge as described in claim 3 wherein:

said swinging bucket including an off-center pinion for causing said swinging bucket to pivot into the elevated position during centrifugation with the centrifugal end of said swinging bucket rising above the centripedal end of said swinging bucket for facilitating the decanting of liquid from said swinging bucket.

6. A centrifuge as described in claim 3 wherein:

said swinging bucket having a tapered configuration with the centrifugal end of said swinging bucket having a wider bore than the centripedal end of said swinging bucket for facilitating the decanting of liquid from said swinging bucket.

7. A centrifuge as described in claim 3 wherein:

said lock being rotationally coupled to said rotational drive means for rotating coaxially with said rotor, said lock, when translated into the locked position during the application of the centrifugal force, contacting said swinging bucket within the elevated position for locking said swinging bucket within the elevated position in the absence of the centrifugal force, said lock, when translated into the unlocked position, disconnecting with said swinging bucket for allowing said swinging bucket to pivot into the rest position in the absence of the centrifugal force.

8. An improved method for separating a pelletable component from a liquid component, the improved method of a type which includes the following steps:

Step (1): loading a swinging bucket with the liquid component,

Step (2): applying a centrifugal force to the swinging bucket for pivoting the swinging bucket from a rest position to an elevated position and for pelleting the pelletable component therein, then Step (3): eliminating the centrifugal force from the swinging bucket, and then Step (4): decanting the liquid component from the swinging bucket, wherein the improvement comprising the following additional step during said Step (2):

Step (2.1): locking the swinging bucket in the elevated position; and wherein:

in said Step (3): the centrifugal force being eliminated from the swinging bucket with the swinging bucket continuing to be locked in the elevated position; and in said Step (4): the liquid component being decanted from the swinging bucket by means of gravity draining with the swinging bucket continuing to be locked in the elevated position.

9. A method for automatically separating a liquid component from a pelletable component comprising the following steps:

Step (1): loading a swinging bucket with the liquid component,

Step (2): applying a first centrifugal force to the swinging bucket for pivoting the swinging bucket from a rest position to an elevated position and for pelleting the pelletable component within the swinging bucket, then Step (3): locking the swinging bucket in the elevated position, then Step (4): eliminating the first centrifugal force from the swinging bucket with the swinging bucket continuing to be locked in the elevated position, and then Step (5): decanting the liquid component from the swinging bucket by means of gravity draining with the swinging bucket continuing to be locked in the elevated position.

10. A method for automatically separating a liquid component from a pelletable component as described in claim 9 and for additionally washing the pelletable component with a second liquid component, the method comprising the following additional steps after said Step (5):

Step (6): applying a second centrifugal force to the swinging bucket with the swinging bucket continuing to be locked in the elevated position; then Step (7): loading the swinging bucket with the second liquid component with the swinging bucket continuing to be locked in the elevated position; then Step (8): eliminating the second centrifugal force from the swinging bucket with the swinging bucket continuing to be locked in the elevated position; and then Step (9): decanting the second liquid component from the swinging bucket by gravity draining with the swinging bucket continuing to be locked in the elevated position.

11. A method for automatically separating a liquid component from a pelletable component as described in claim 9 and for additionally washing the pelletable component with a second liquid component, the method comprising the following additional steps after said Step (5):

Step (6): applying a second centrifugal force to the swinging bucket; then

Step (6): unlocking the swinging bucket, eliminating the second centrifugal force, and allowing the swinging bucket to pivot from the elevated position to the rest position; then Step (7): loading the swinging bucket with the second liquid component; then Step (8): applying a third centrifugal force to the swinging bucket; then Step (9): locking the swinging bucket in the elevated position, then Step (10): eliminating the third centrifugal force from the swinging bucket with the swinging bucket continuing to be locked in the elevated position, and then Step (11): decanting the second liquid component from the swinging bucket by gravity draining with the swinging bucket continuing to be locked in the elevated position.

12. A method for automatically separating a liquid component from a pelletable component as described in claim 9 and for additionally treating the pellet with a reagent, the method comprising the following additional steps after said Step (5):

Step (6): applying a second centrifugal force to the swinging bucket with the swinging bucket continuing to be locked in the elevated position; then Step (7): adding the reagent to the swinging bucket with the swinging bucket continuing to be locked in the elevated position and driving the reagent onto the first pellet by means of the second centrifugal force; and then Step (8): allowing the reagent to incubate with the pellet.

13. A method for automatically separating a liquid component from a pelletable component and for treating the pellet with a reagent as described in claim 12 and for additionally washing reagent treated, pellet with a diluant, the method comprising the following additional steps after said Step (8):

Step (9): adding a diluant to the swinging bucket for diluting the reagent with the second centrifugal force continuing to be applied to the swinging bucket and the swinging bucket continuing to be locked in the elevated position; then Step (10): eliminating the second centrifugal force from the swinging bucket with the swinging bucket continuing to be locked in the elevated position, and then Step (11): decanting the reagent and the diluant from the swinging bucket by gravity draining while leaving the pellet therein.

14. A method for automatically separating a liquid component from a pelletable component as described in claim 9 for additionally treating the pellet with a reagent, the method comprising the following additional steps after said Step (5):

Step (6): applying a second centrifugal force to the swinging bucket; then

Step (6): unlocking the swinging bucket; then

Step (7): eliminating the second centrifugal force and allowing the swinging bucket to pivot from the elevated position to the rest position; then Step (8): adding the reagent to the swinging bucket with the swinging bucket continuing to hang in the rest position; and then Step (9): allowing the reagent to incubate with the pellet.

15. A method for automatically separating a liquid component from a pelletable component and for treating the pellet with a reagent as described in claim 14 and for additionally washing reagent treated pellet with a diluant, the method comprising the following additional steps after said Step (8):

Step (9): adding a diluant to the swinging bucket for diluting the reagent; then Step (10): applying a third centrifugal force to the swinging bucket for pivoting the swinging bucket from the rest position to the elevated position; then Step (11): locking the swinging bucket within the elevated position; then Step (12): eliminating the third centrifugal force and allowing the swinging bucket to pivot from the elevated position to the rest position; then Step (10): decanting the reagent from the swinging bucket by gravity draining while leaving the pellet therein with the swinging bucket continuing to be locked within the elevated position.

* * * * *